US006174201B1

(12) United States Patent
Murakami et al.

(10) Patent No.: US 6,174,201 B1
(45) Date of Patent: Jan. 16, 2001

(54) WATERPROOF CONNECTOR AND METHOD OF ASSEMBLING THE SAME

(75) Inventors: Takao Murakami; Masaru Fukuda, both of Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/593,153

(22) Filed: Jun. 14, 2000

(30) Foreign Application Priority Data

Jun. 15, 1999 (JP) ..... 11-168767

(51) Int. Cl.[7] ..... H01R 13/40
(52) U.S. Cl. ..... 439/587; 439/274; 439/275
(58) Field of Search ..... 439/587, 589, 439/271, 274, 275, 279

(56) References Cited

U.S. PATENT DOCUMENTS 6,102,740 * 8/2000 Murakami et al. ..... 439/587

FOREIGN PATENT DOCUMENTS 11-329571 11/1999 (JP) .
11-354200 12/1999 (JP) .

OTHER PUBLICATIONS

Patent Abstracts of Japan 11329571 Nov. 30, 1999.

* cited by examiner

*Primary Examiner*—Paula Bradley
*Assistant Examiner*—Tho D. Ta

(74) *Attorney, Agent, or Firm*—Sughrue, Mion, Zinn, Macpeak & Seas, PLLC

(57) ABSTRACT

A plurality of inner units respectively have a terminal chamber for accommodating a terminal to which an electric wire is connected, which are to be detachably combined with each other to constitute an inner housing. Waterproof rubber plugs respectively have a through hole through which the electric wire is inserted. A spacer has side walls for defining a chamber provided with a bottom wall, into which the inner units are fitted. Through holes, through which the respective electric wires are inserted, are formed on the bottom wall of the spacer so as to face the associated terminal chambers of the respective inner units when the inner housing is fitted into the chamber of the spacer. An outer housing has sidewalls for defining a chamber provided with a bottom wall, into which the spacer is fitted. Through holes, through which the respective electric wires are inserted, are formed on the bottom wall of the outer housing so as to face the associated through holes of the spacer when the spacer is fitted into the chamber of the outer housing. Recesses are formed on the bottom wall of the outer housing so as to communicate with the respective through holes in order to accommodate the rubber plugs when the spacer is completely fitted into the chamber of the outer housing, thereby sealing the electric wires and the terminal chambers. Entrance peripheries of the respective recesses being tapered. Rubber plug holders are formed on the bottom wall of the spacer so as to communicate with the through holes of the spacer in order to hold the rubber plugs together with the respective tapered peripheries of the recesses therebetween before the rubber plugs are accommodated in the respective recesses.

3 Claims, 8 Drawing Sheets

PRIOR ART

PRIOR ART

PRIOR ART

WATERPROOF CONNECTOR AND METHOD OF ASSEMBLING THE SAME

BACKGROUND OF THE INVENTION

The present invention relates to a small size multi-way waterproof connector with an improved waterproof property between a connector housing and a plurality of electric wires connected with terminals, and a method of assembling the same.

A related waterproof connector, which is disclosed in Japanese Patent Publication No. 11-354200, will be explained with reference to FIGS. 6 to 8. A connector housing 11 of a waterproof connector 10' comprises a synthetic resin inner housing 12 having a plurality of terminal chambers 13 formed integrally therewith, a synthetic resin outer housing 17 for fitting the inner housing 12 to the inside thereof, and a synthetic resin spacer 28 disposed between the inner housing 12 and the outer housing 17 for holding female terminals 14 accommodated in each terminal chamber 13 of the inner housing 12.

As shown in FIGS. 6 and 7, the inner housing 12 has a box part 12*a* with the rear side of the upper and lower faces opened, for forming the terminal chambers 13 in a space formed with the center horizontal wall 12*b* and vertical side walls 12*c*, serving also as partition walls in the vertical direction. The female terminals 14 can be accommodated in each terminal chamber 13. Moreover, engagement claws 15 are formed integrally, projecting from both sides and the center of the upper and lower faces of the box part 12*a* as well as flange parts (not illustrated) are formed integrally projecting from the front end of the both side center parts. Rectangular insertion holes 12*d* for inserting male terminals of a mating connector (not illustrated) therethrough are formed in the front wall of the box part 12*a* at a position corresponding to each terminal chamber 13. Furthermore, a pair of press-connecting blades 14*b* are formed by bending in both side plate parts in the rear part of a box part 14*a* of the female terminals.

As shown in FIGS. 6 and 7, the outer housing 17 has a double box-like shape with the front side opened, with a substantially quadrilateral pipe-like inner wall part 17*a*, a substantially quadrilateral pipe-like outer wall part 17*b* for containing the inner wall part 17*a*, and a bottom wall part (wall part) 17*c*, connecting the rear parts of the inner and outer wall parts 17*a*, 17*b*. A thick portion is provided in the center of the bottom wall part 17c. Rubber plug chambers 19 having a large diameter round cross-section for accommodating waterproof rubber plugs 18 by press-in are formed at a position corresponding to each terminal chamber 13 at the front side with respect to the thick portion as well as electric wire insertion holes 21 having a small diameter round cross-section for inserting electric wires 20 therethrough are formed, communicating with each corresponding rubber plug chamber 19 at the rear side with respect to the thick portion.

Moreover, rectangular engagement holes 22 to be engaged with each engagement claw 15 at both sides of the upper and lower faces of the box part 12*a* of the inner housing 12 are formed at both front sides of the upper and lower walls of the inner wall part 17*a* of the outer housing 17 as well as rectangular longitudinal engagement holes 23 to be engaged with each engagement claw 15 at the center of the upper and lower faces of the box part 12*a* of the inner housing 12 are formed at the front center portion of the upper and lower walls of the inner wall part 17*a*. Furthermore, a V-shaped packing receiving part 25 for receiving an annular rubber waterproof packing 24 is formed integrally, projecting from the deep part of the outer face side of the inner wall part 17*a* of the outer housing 17.

Tapered faces 26 are formed in the front rim of the inner face side of the inner wall part 17*a* of the outer housing at a position corresponding to each engagement hole 22, 23. Moreover, engagement holes 27 to be engaged with flexible engaging arms of a mating connector (not illustrated) are formed at the front side of the upper and lower walls of the outer wall part 17*b* of the outer housing 17.

As shown in FIGS. 6 and 7, the spacer 28 forms a box-like shape with the front side opened, with a substantially quadrilateral pipe-like body 28. to be fitted with the inner face side of the inner wall part 17*a* of the outer housing 17, a substantially quadrilateral pipe-like brim part 28*b* formed integrally with the front end of the body 28*a,* bent rearward therefrom, to be fitted with the outer face side of the inner wall part 17*a* of the outer housing, and a bottom wall part 28*c* of the body 28*a*.

Accordingly, the box part 12*a* of the inner housing 12 can be fitted into the body 28*a* of the spacer 28. Rib-like projections 29 for preventing fall-off of the terminals are formed integrally, projecting from the inner face of the upper and lower walls of the body 28*a* of the spacer 28, to be engaged with the rear end rim of the box part 14*a* of the female terminals 14 accommodated in each terminal chamber 13.

Moreover, notch portions 30 are formed in the front side of the portion connecting the body 28*a* and the brim part 28*b* of the spacer 28 at a position corresponding to each engagement claw 15 of the inner housing 12. Engagement claws 32 to be engaged with each engagement hole 23 of the outer housing 17 are formed integrally, projecting form the outer face side of the upper and lower walls of the body 28*a* of the spacer 28 between the upper and lower side notch portions 30. Furthermore, the tip portion of the brim part 28*b* can hold the packing 24 engaged with the packing receiving part 25 of the inner wall part 17*a* of the outer housing 17 when the fitting operation with respect to the outer housing 17 is completed.

Moreover, electric wire insertion holes 33 are formed in the bottom wall part 28*c* of the spacer 28 at a position corresponding to each electric wire insertion hole 21 of the outer housing 17. Furthermore, the bottom wall part 28*c* of the spacer 28 can hold the rubber plugs 18 inserted in each rubber plug chamber 19 of the bottom wall part 17*c* of the outer housing when the fitting operation with respect to the outer housing 17 is completed. As shown in FIG. 6, each electric wire 20 inserted through each electric wire insertion hole 21 of the outer housing 17, each rubber plug 18 and each electric wire insertion hole 33 of the spacer 28 is press-connected between the pair of the press-connecting blades 14*b* of each female terminal accommodated in each terminal chamber 13 of the inner housing 12 so that each terminal chamber 13 and each electric wire 20 are sealed with the rubber plug 18 and the packing 24, respectively.

Reverse conical tapered faces 19*a* are formed at the entrance side of each rubber plug chamber 19 inside the bottom wall part 17*c* of the outer housing 17. Moreover, reverse conical tapered faces 28*d*, serving also as rubber plug pressing parts, are formed around each electric wire insertion hole 33 outside the bottom wall part 28*c* of the spacer 28. The rubber plugs 18 can be interposed between the reverse conical faces 19*a* of each rubber plug chamber 19 and the reverse conical faces 28*d* around each electric wire insertion hole 33 of the spacer 28 before accommodating the rubber plugs 18 in each rubber plug chamber 19 of the outer housing 17 (at the time of the temporary engagement with the front side of the body 28*a* of the spacer 28 in the inner wall part 17*a* of the outer housing 17 shown in FIG. 6).

Moreover, as shown in FIG. 8, conical tapered faces 18*a* are formed at both end sides of the rubber plugs 18 for inserting the electric wires 20 therethrough. The inner diameter Rb (that is, the diameter of the electric wire insertion holes 18*b* of the rubber plugs 18) of the rubber plugs 18 is set to be equal to or larger than the diameter R of the electric wires 20 ($Rb \geqq R$). Furthermore, the outer diameter Ra of the rubber plugs 18 is formed to be larger than the diameter D of the rubber plug chambers 19 such that the sealing relationship ($Ra-Rb+R>D$) can be provided in the rubber plug chambers 19.

The waterproof rubber plugs 18 have a substantially cylindrical shape with the rugged inner and outer circumferential faces so that the electric wires 20 can be inserted through the inside thereof without having a gap.

In assembling the waterproof connector 10' with the above-mentioned configuration, the packing 24 is inserted and set preliminarily in the packing receiving part 25 of the inner wall part 17*a* of the outer housing 17 comprising the outside of the connector housing 11. The electric wires 20 are inserted through the plurality of the electric wire insertion holes 21 of the bottom wall part 17*c* of the outer housing 17 from the outside thereof, and the electric wires 20 are inserted through each electric wire insertion hole 33 of the bottom wall part 28*c* of the spacer 28 from the outside thereof after inserting the electric wires 20 through the rubber plugs 18.

As shown in FIG. 6, the front side of the body 28*a* of the spacer 28 is fitted into the inner wall part 17*a* of the outer housing 17 for temporary engagement with the rubber plugs 18 interposed between the reverse conical face 19*a* of each rubber plug chamber 19 and the reverse conical face 28*d* of each electric wire insertion hole 33 of the bottom wall part 28*c* of the spacer 28 without being accommodated in each rubber plug chamber 19 inside the bottom wall part 17*c* of the outer housing 17. Then, each electric wire 20 is press-connected to the pair of the press-connecting blades 14*b* of each terminal 14 accommodated in the plurality of the terminal chambers 13 in the inner housing 12 comprising the inside of the connector housing 11.

Next, as shown in FIG. 7, if the inner housing 12 is fitted to the inside of the body 28*a* of the spacer 28 such that the body 28*a* of the spacer 28 is fitted completely in the inner wall part 17*a* of the outer housing for the full engagement while sliding each electric wire 20 with respect to each electric wire insertion hole 33, 21 of the bottom wall part 28*c* of the spacer 28 and the bottom wall part 17*c* of the outer housing 17, the assembly of the waterproof connector 10' with each electric wire 20 sealed by each rubber plug 18 can be completed by accommodating each rubber plug 18 in each rubber plug chamber 19 with pressure by the reverse conical face 28*d* around each electric wire insertion hole 33 of the bottom wall part 28*c* of the spacer 28. Accordingly, since pressure is not applied from the rubber plugs 18 at the time of fitting the inner housing 12 into the spacer 28 fitted to the inside of the outer housing 17 via the rubber plugs 18 in the temporarily engaged state, the waterproof connector 10' can be assembled smoothly without bending of the electric wires 20, and thus the assembly operativity as a whole can further be improved.

However, according to the related waterproof connector 10', the electric wires 20 are inserted through the rubber plugs 18 not accommodated in each rubber plug chamber 19 of the outer housing 17, and the electric wires 20 are press-connected to the female terminal 14 accommodated in the terminal chambers 13 of the inner housing 12 so that the rubber plugs 18 are accommodated with pressure each rubber plug chamber 19 of the outer housing 17 by fully engaging the inner housing 12 in the inside of the outer housing 17 via the spacer 28 while sliding and moving each electric wire 20 with the inner housing 12 in the electric wire insertion holes 18*b* of the rubber plugs 18. Therefore, since the rubber plugs 18 and the electric wires 20 are set while sliding, in the case the number of the rubber plugs 18 is large, the total sum of the sliding friction force between the rubber plugs 18 and the electric wires 20 becomes large so that the fitting load of the inner housing 12 and the outer housing 17 can be large so as to cause a trouble in the production of the wire harness. That is, in the case the number of the rubber plugs 18 is large, there is a risk of deteriorating the assembly operativity of the waterproof connector 10' due to the increased operation load (fitting load) by the sliding friction between the rubber plugs 18 and the electric wires 20 at the time of the housing fitting operation of fitting the inner housing 12 into the outer housing 17 side via the spacer 28.

SUMMARY OF THE INVENTION

Accordingly, in order to solve the above-mentioned problems, an object of the invention is to provide a small size multi-way waterproof connector with an improved assembly operativity, and an assembling method for the waterproof connector.

In order to achieve the above object, according to the present invention, there is provided a waterproof connector comprising:

- a plurality of inner units, each inner unit having a terminal chamber for accommodating a terminal to which an electric wire is connected, which are to be detachably combined with each other to constitute an inner housing;
- a plurality of waterproof rubber plugs, each plug having a through hole through which the electric wire is inserted;
- a spacer having side walls for defining a chamber provided with a bottom wall, into which the inner units are fitted;
- a plurality of through holes, through which the respective electric wires are inserted, formed on the bottom wall of the spacer so as to face the associated terminal chambers of the respective inner units when the inner housing is fitted into the chamber of the spacer;
- an outer housing having sidewalls for defining a chamber provided with a bottom wall, into which the spacer is fitted;
- a plurality of through holes, through which the respective electric wires are inserted, formed on the bottom wall of the outer housing so as to face the associated through holes of the spacer when the spacer is fitted into the chamber of the outer housing;
- a plurality of recesses formed on the bottom wall of the outer housing so as to communicate with the respective through holes of the outer housing in order to accommodate the rubber plugs when the spacer is completely fitted into the chamber of the outer housing, thereby sealing the electric wires and the terminal chambers, entrance peripheries of the respective recesses being tapered;

a plurality of rubber plug holders formed on the bottom wall of the spacer so as to communicate with the through holes of the spacer in order to hold the rubber plugs together with the respective tapered peripheries of the recesses therebetween before the rubber plugs are accommodated in the respective recesses.

According to the above configuration, there can be dispersed the sliding friction force between the rubber plugs and the electric wires at the time of fitting the inner housing into the spacer fitting to the inside of the outer housing while sliding the electric wires with respect to each electric wire insertion hole of the spacer and the outer housing, generation of bend of each electric wire due to the pressure from each rubber plug can be prevented even in the case the number of the rubber plugs is large, and thus the assembly operativity of the waterproof connector can be improved. That is, production of the wire harness can be facilitated. Moreover, since the rubber plugs can be accommodated smoothly and certainly in each rubber plug chamber of the outer housing owing to the rubber plug holders of the spacer, the sealing property of the waterproof connector can be improved.

Preferably, the outermost inner units respectively have an engagement member engaged with the outer housing, and at least one inner units arranged between the outermost inner units has an engagement member engaged with both adjacent inner units when the inner housing is composed of at least three inner units.

According to the above configuration, since the rubber plugs can be accommodated easily and certainly in each rubber plug chamber of the outer housing at the time of the full engagement by completely fitting the spacer fitted to the inside of the outer housing via the rubber plugs in the temporarily engaged state into the inside of the outer housing after attaching the divided inner units as well as the full engagement state can be maintained further certainly owing to the engagement of each engagement member of each outermost inner unit and the outer housing, the assembly quality of the waterproof connector can be improved.

According to the present invention, the above waterproof connector is assembled by the steps of:

fitting the rubber plugs into the entrance peripheries of the associated recesses of the outer housing provisionally;

fitting the spacer into the chamber of the outer housing provisionally such that the rubber plugs are held between the rubber plug holders of the spacer and the entrance peripheries of the recesses;

passing the electric wires through the associated through holes on the bottom wall of the outer housing;

passing each electric wire through the through hole of the associated rubber plug;

passing each the electric wires through the associated through holes of the spacer;

connecting the electric wires to the associated terminals;

fitting each terminal into the terminal chamber of the associated inner unit;

fitting the respective inner units into the chamber of the spacer successively to constitute the inner housing therein; and fitting the spacer into the chamber of the outer housing completely while press-fitting the rubber plugs into the associated recesses.

According to the above configuration, since the plurality of the divided inner units constituting the inner housing are successively fitted into the spacer fitted to the inside of the outer housing via the rubber plugs in the temporary engagement state, even in the case a large number of the rubber plugs are used, the sliding friction force between the rubber plugs and the electric wires can be dispersed so that the electric wires can be assembled smoothly without bend, and thus the operation load (fitting load) can be alleviated. Accordingly, a multi-way waterproof connector having the excellent waterproof property can be assembled easily in a short time so that the assembly operativity as a whole can further be improved.

DETAILED DESCRIPTION OF THE PREFERRED EMBODIMENTS

Figure 1:
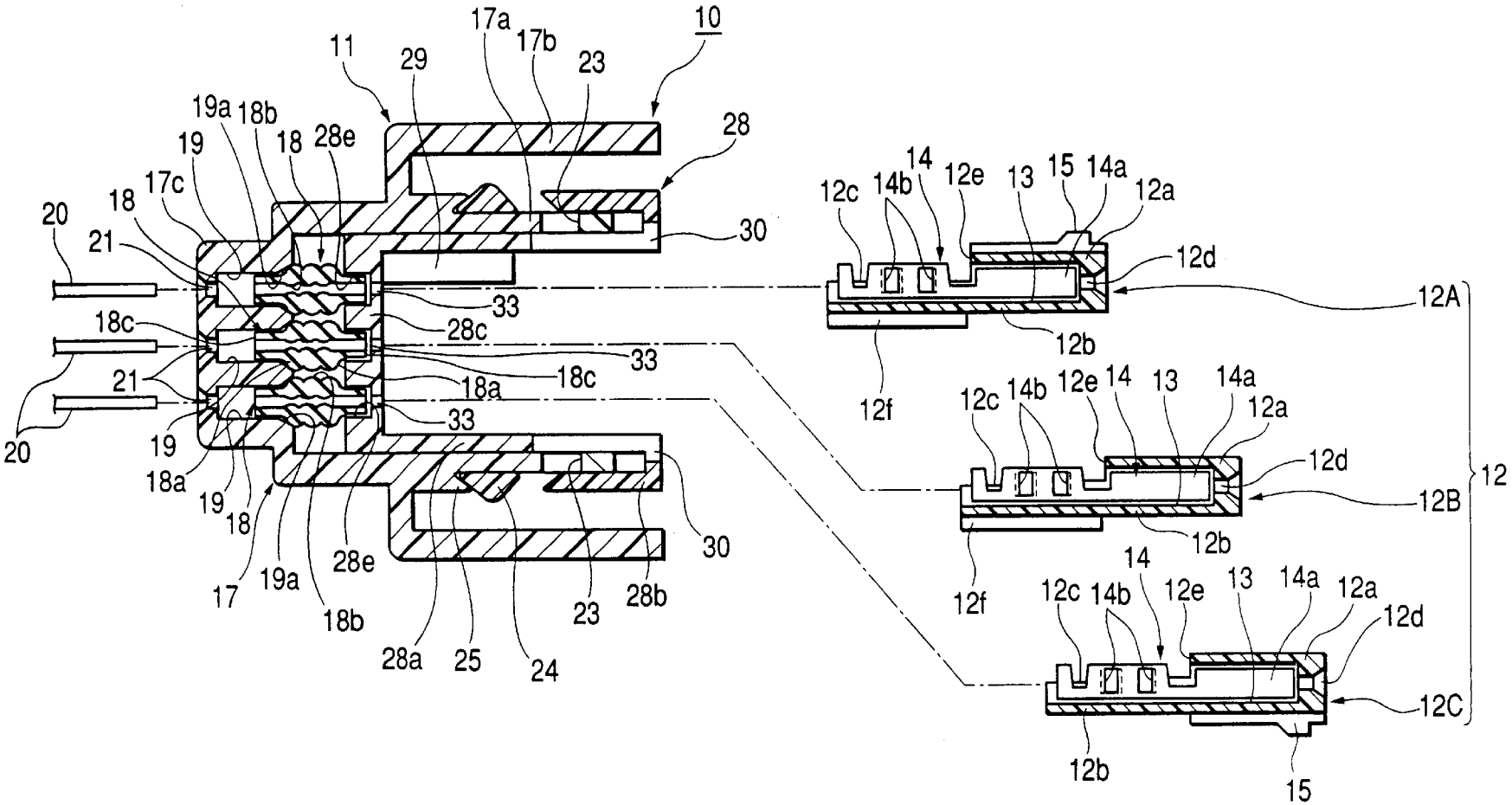
FIG. 1 is a cross-sectional view of a waterproof connector according to one embodiment of the present invention, showing the state before fitting a plurality of divided inner units into the inside of a spacer in the temporary engagement state of an outer housing and the spacer.

Hereinafter an embodiment of the invention will be explained with reference to the drawing.

Figure 2:
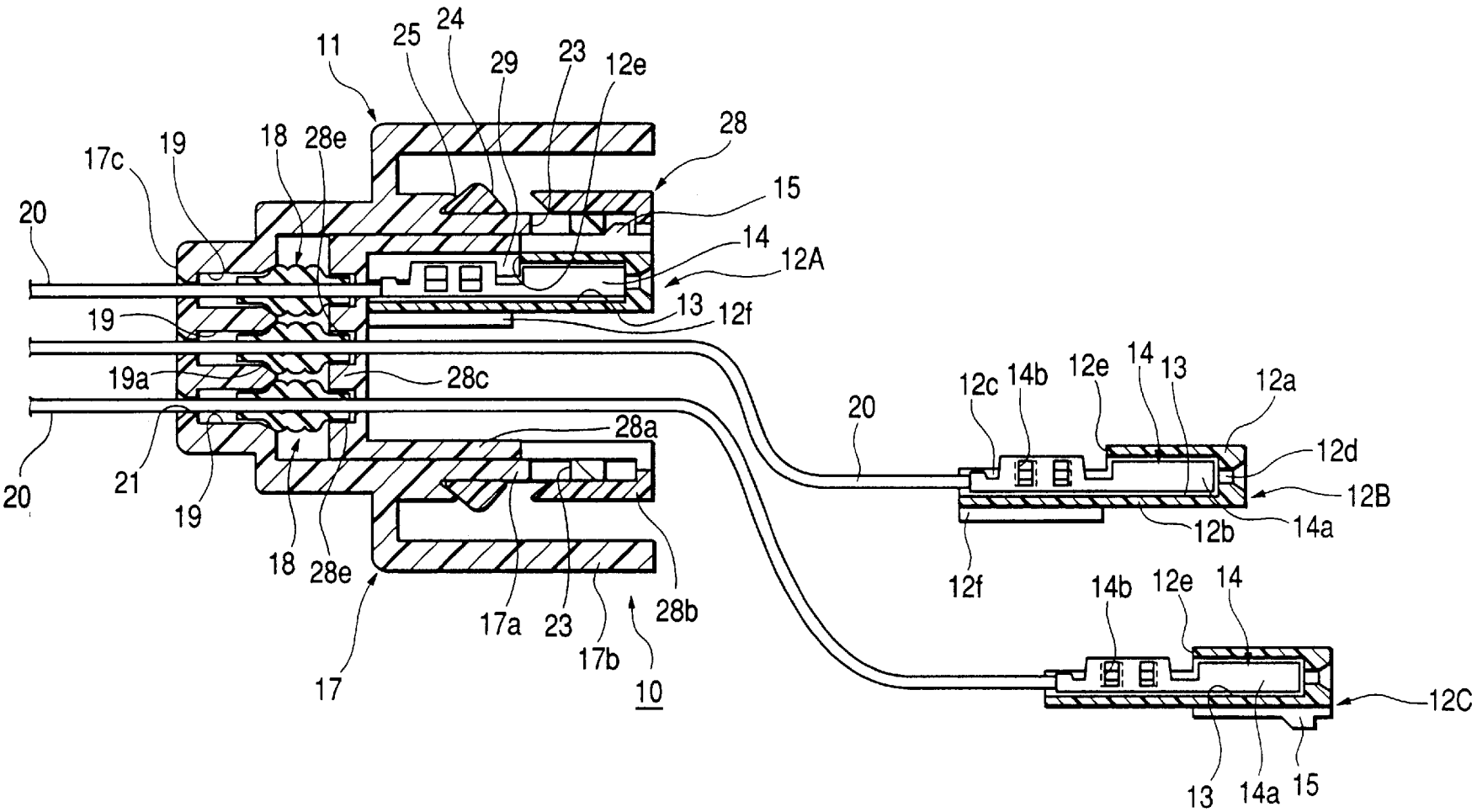
FIG. 2 is a cross-sectional view showing the state of successively fitting the plurality of the divided inner units to the inside of the spacer in the temporary engagement state.
Figure 3:
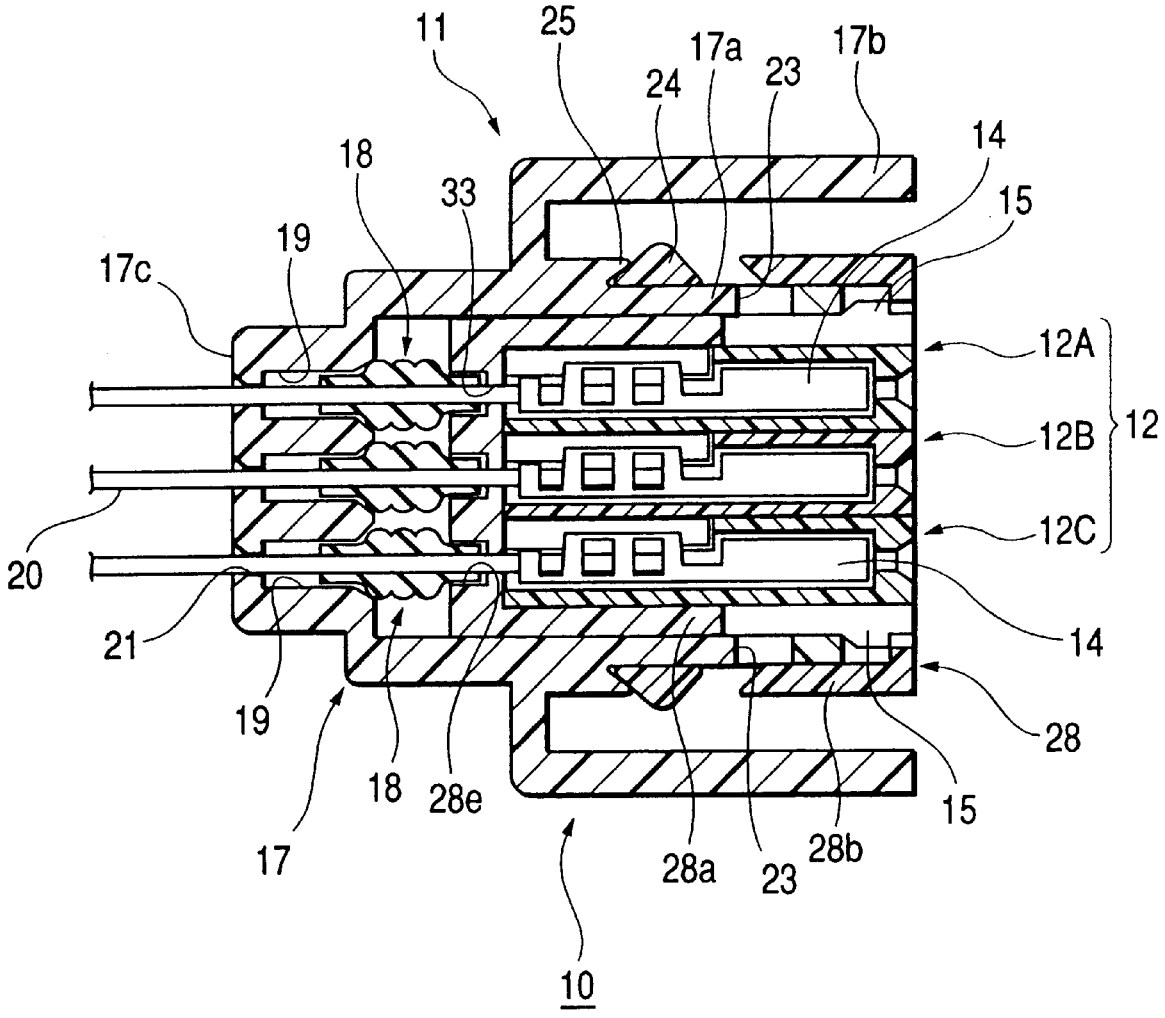
FIG. 3 is a cross-sectional view showing the temporary engagement state of the outer housing and the spacer.
Figure 4:
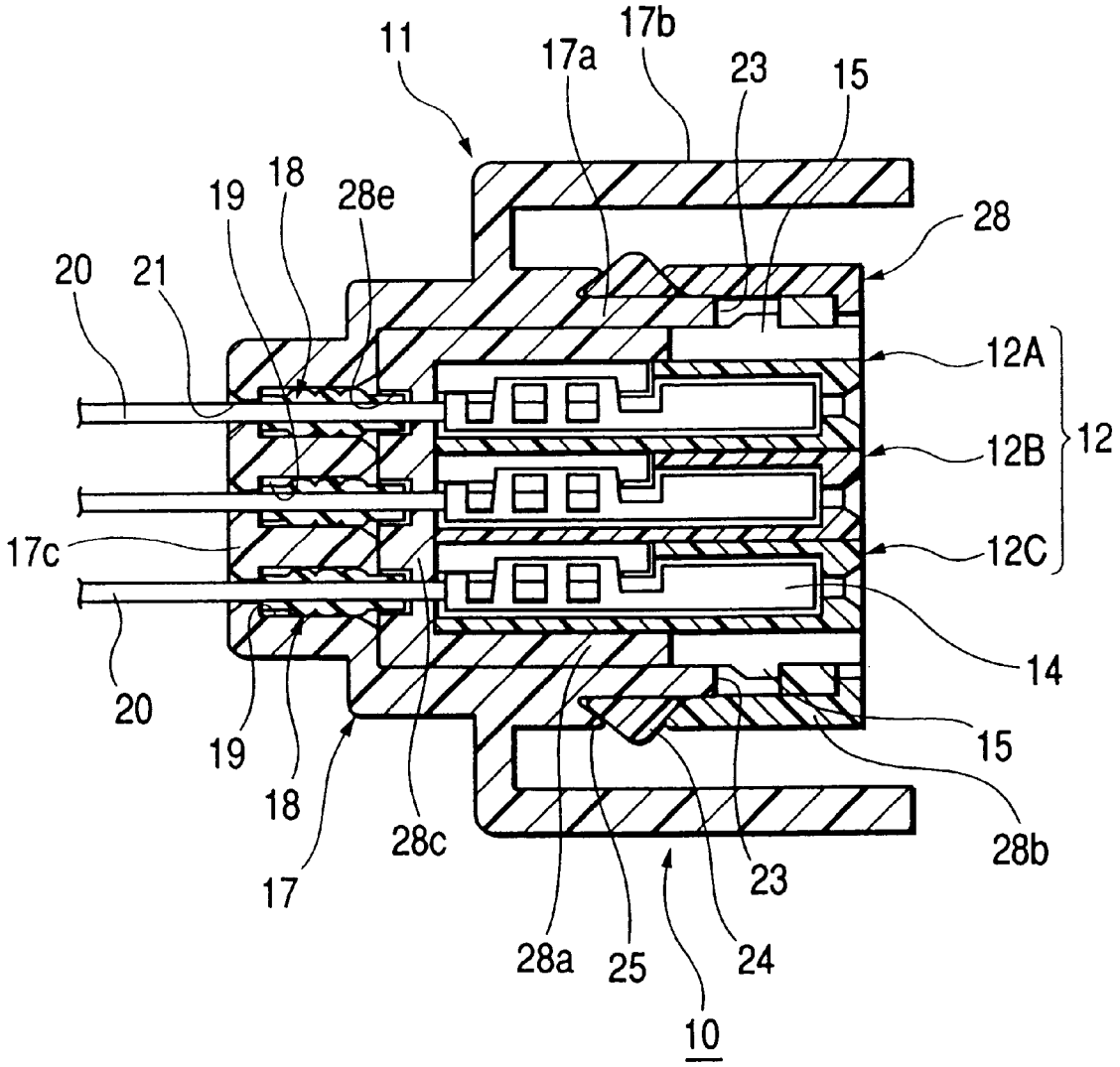
FIG. 4 is a cross-sectional view showing the full engagement state of the outer housing and the spacer.
Figure 5:
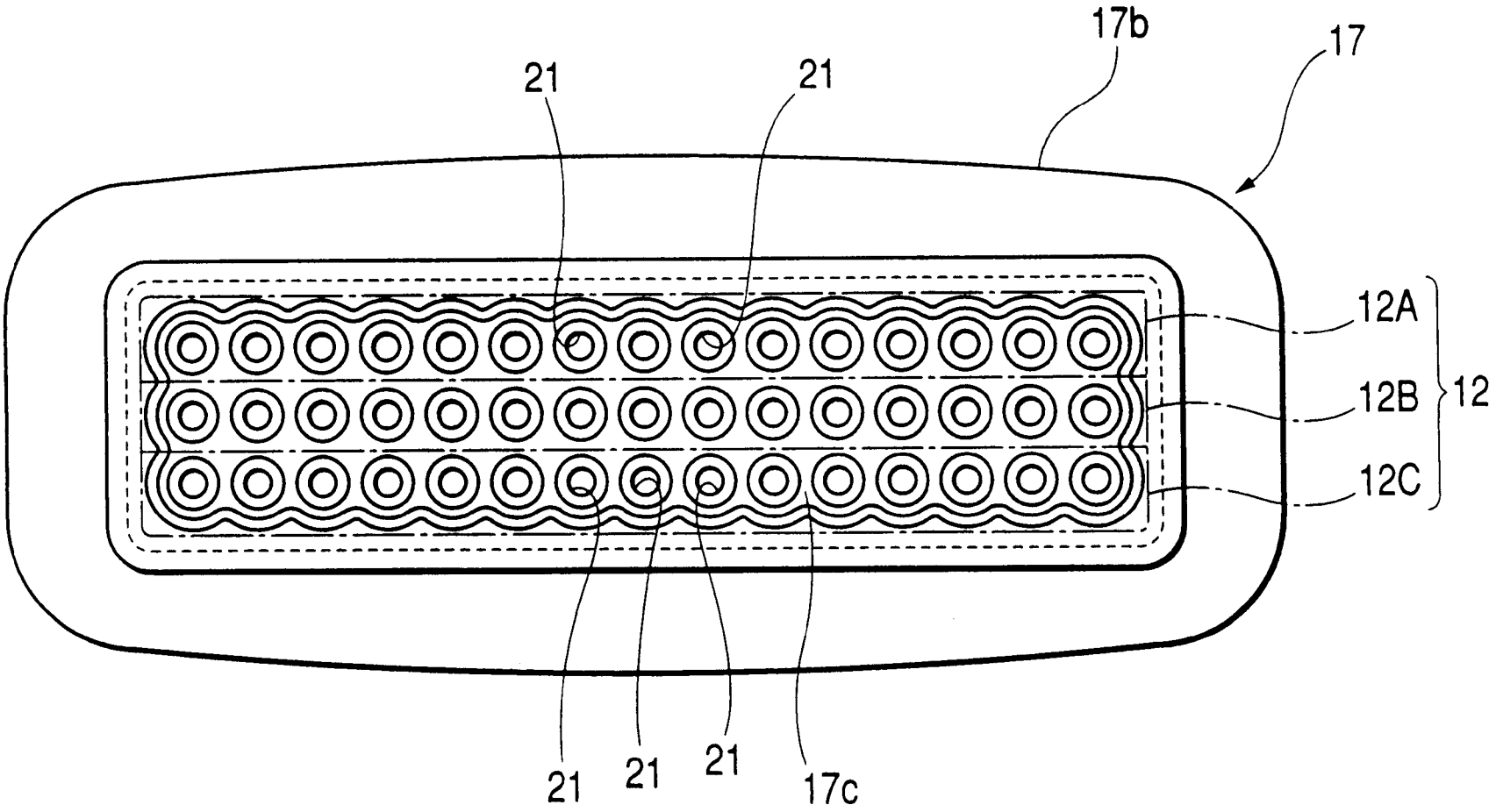
FIG. 5 is a rear view of the outer housing.
Figure 6:
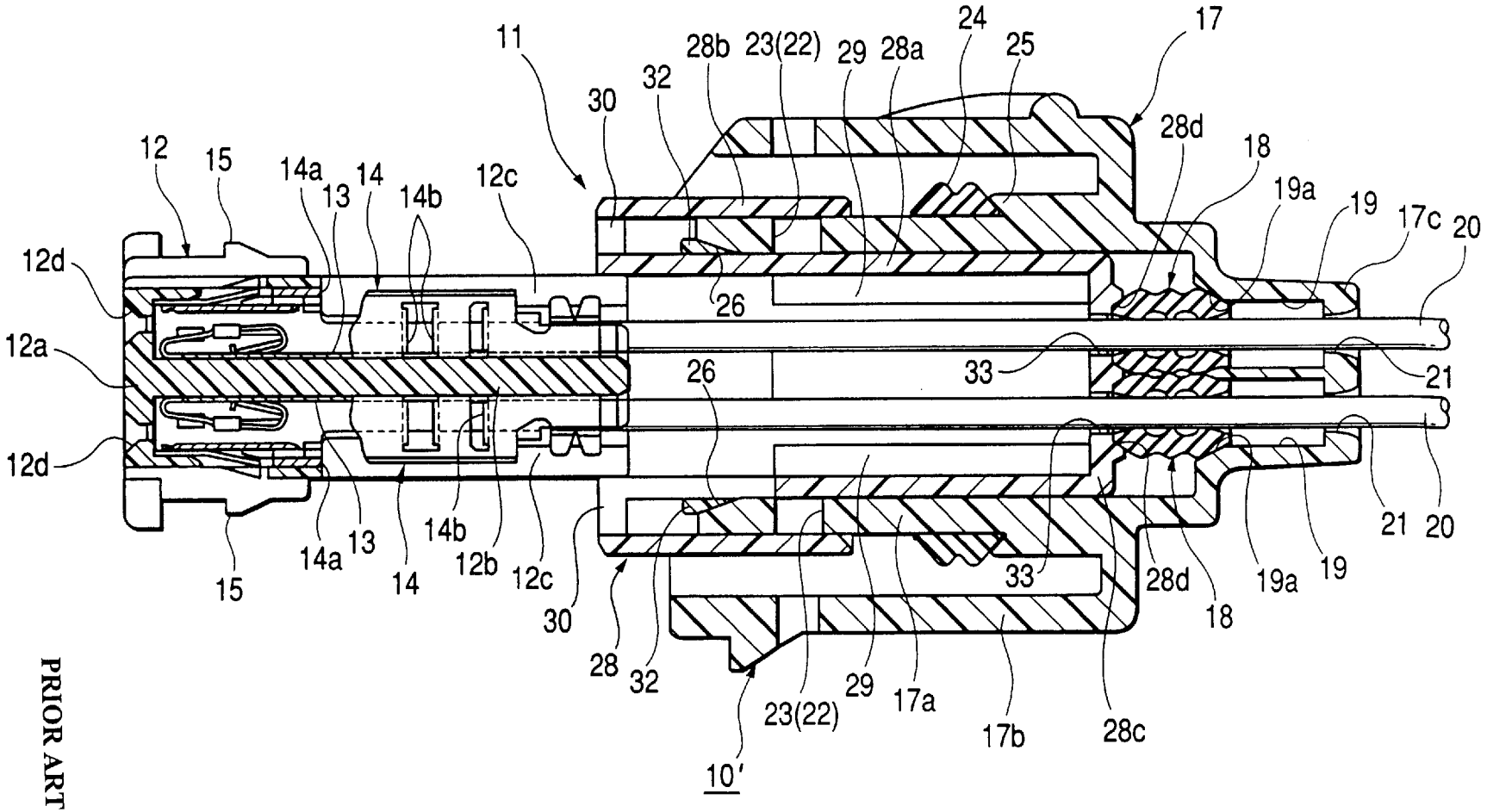
FIG. 6 is a cross-sectional view of a related waterproof connector, showing the temporary engagement state of an outer housing and a spacer.
Figure 7:
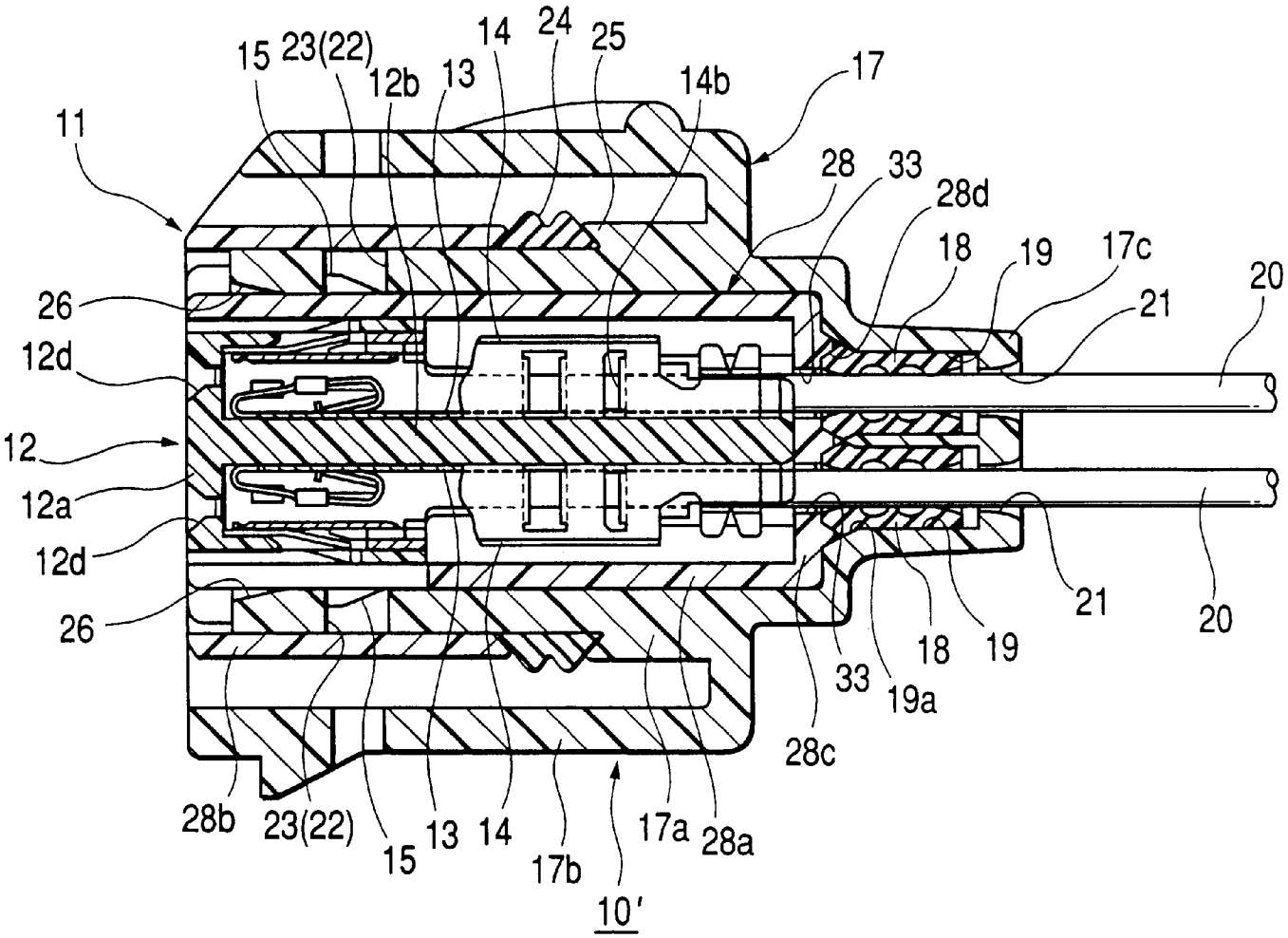
FIG. 7 is a cross-sectional view showing the full engagement state of the outer housing and the spacer of the related waterproof connector.
Figure 8:
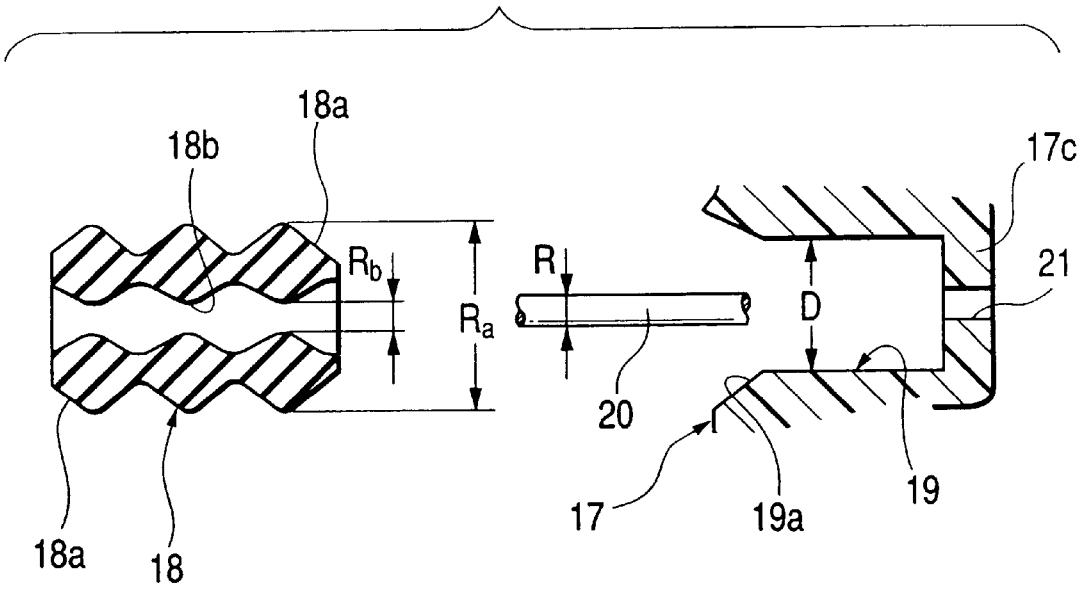
FIG. 8 is an enlarged explanatory diagram of an essential part of the related waterproof connector.

FIG. 1 is a cross-sectional view of a waterproof connector according to one embodiment of the present invention, showing the state before fitting a plurality of divided inner units into the inside of a spacer in the temporary engagement state of an outer housing and the spacer. FIG. 2 is a cross-sectional view showing the state of successively fitting the plurality of the divided inner units to the inside of the spacer in the temporary engagement state. FIG. 3 is a cross-sectional view showing the temporary engagement state of the outer housing and the spacer. FIG. 4 is a cross-sectional view showing the full engagement state of the outer housing and the spacer. FIG. 5 is a rear view of the outer housing.

As shown in FIGS. 1 to 4, similar to the related connector housing 10', a connector housing 11 of a waterproof connector 10 comprises a synthetic resin inner housing 12 having a plurality of terminal chambers 13 formed integrally therewith, a synthetic resin outer housing 17 for fitting the inner housing 12 to the inside thereof, and a synthetic resin spacer 28 to be disposed between the inner housing 12 and the outer housing 17 for holding female terminals 14 accommodated in each terminal chamber 13 of the inner housing 12.

As shown in FIGS. 1 to 5, the inner housing 12 comprises detachable divided inner units 12A, 12B, 12C at the upper, middle, and lower stages each with a plurality of terminal chambers 13 in the horizontal direction (right and left direction) formed therein. Each electric wire 20 inserted through each electric wire insertion hole 21 of the outer housing 17, an electric wire insertion hole 18*b* of each rubber plug 18, and each electric wire insertion hole 33 of a spacer 28 is press-connected to each pair of the press-connecting blades 14*b* of the female terminals accommodated in each terminal chamber 13 of each divided inner unit 12A, 12B, 12C comprising the inner housing 12.

Moreover, each divided inner unit 12A, 12B, 12C can be attached with each other when they are accommodated in the inside of the body 28*a* of the spacer 28. That is, as shown in FIGS. 2 and 4, if the spacer 28 is fitted completely in the inner wall part 17*a* of the outer housing 17 with the upper stage divided inner unit 12A accommodated in the body 28*a* of the spacer 28, each engagement claw 15 of the box part 12*a* of the upper stage divided inner unit 12A is engaged with each rectangular engagement hole 23 of the inner wall part 17*a* of the outer housing 17. Accordingly, the rear end rim 12*e* of the box part 12*a* of the upper stage divided inner unit 12A and the rear end rim of the box part 14*a* of the female terminals 14 accommodated in each terminal chamber 13 are locked by each projection 29 projecting to the inner face of the upper wall of the body 28*a* of the spacer 28 so as to certainly prevent fall-off of the female terminals 14 from each terminal chamber 13.

Furthermore, if the middle stage divided inner unit 12B is accommodated below the upper stage divided inner unit 12A in the body 28*a* of the spacer 28, the projection 12*f* at the lower face of the horizontal wall 12*b* of the upper stage divided inner unit 12A is contacted with the rear end rim 12*e* of the box part 12*a* of the middle stage divided inner unit 12B and the rear end rim of the box part 14*a* of the female terminals 14 accommodated in each terminal chamber 13 of the middle stage divided inner unit 12B so as to certainly prevent fall-off of the female terminals 14 from each terminal chamber 13 of the middle stage divided inner unit 12B.

Furthermore, if the lower stage divided inner unit 12C is accommodated below the middle stage divided inner unit 12B in the body 28*a* of the spacer 28, the projection 12*f* at the lower face of the horizontal wall 12*b* of the middle stage divided inner unit 12B is contacted with the rear end rim 12*e* of the box part 12*a* of the lower stage divided inner unit 12C and the rear end rim of the box part 14*a* of the female terminals 14 accommodated in each terminal chamber 13 of the lower stage divided inner unit 12C so as to certainly prevent fall-off of the female terminals 14 from each terminal chamber 13 of the lower stage divided inner unit 12C. Moreover, as shown in FIG. 4, if the spacer 28 is completely fitted into the inner wall part 17*a* of the outer housing 17 with the lower stage divided inner unit 12C accommodated in the body 28*a* of the spacer 28, each engagement claw 15 of the horizontal wall 12*b* of the lower stage divided inner unit 12C is engaged with each rectangular engagement hole 23 of the inner wall part 17*a* of the outer housing 17. Accordingly, the divided inner units 12A, 12B, 12C attached by being accommodated in the body 28*a* of the spacer 28 are locked when the spacer 28 is fitted completely in the inner wall part 17*a* of the outer housing 17 so as not to fall off from the body 28*a* of the spacer 28. At the time, the engagement claw (not illustrated) of the spacer 28 is engaged with the engagement hole 23 of the outer housing 17 as well.

The projections 12*f* of the upper and middle stage inner units 12A, 12B are formed integrally, projecting from the lower face of each horizontal wall 12*b*. Moreover, the projections 15 of the upper stage divided inner unit 12A to be engaged with each engagement hole 23 at the upper side of the inner wall part 17*a* of the outer housing 17 are formed integrally, projecting from the upper face side of the box part 12*a* as well as the projections 15 of the lower stage divided inner unit 12C to be engaged with each engagement hole 23 at the lower side of the inner wall part 17*a* of the outer housing 17 are formed integrally, projecting from the lower face side of the horizontal wall 12*b*.

As shown in FIGS. 1 to 4, a reverse conical tapered face 19*a* is formed at the entrance side of each rubber plug chamber 19 inside the bottom wall part 17*c* of the outer housing 17. Moreover, a recessed rubber plug holder 28*e*, serving also as a rubber plug pressing part, is formed around each electric wire insertion hole 33 outside the bottom wall part 28*c* of the spacer 28. The rubber plugs 18 can be interposed between the reverse conical face 19*a* of each rubber plug chamber 19 and the recessed rubber plug holder 28*e* around each electric wire insertion hole 33 of the spacer 28 before accommodating the rubber plugs 18 in each rubber plug chamber 19 of the outer housing 17 (at the time of the temporary engagement state with the front side of the body 28*a* of the spacer 28 fitted in the inner wall part 17*a* of the outer housing 17 shown in FIGS. 1 to 3) so that the rubber plugs 18 can be accommodated in each rubber plug chamber 19 after attaching the divided inner units 12A, 12B, 12C by accommodating in the body 28*a* of the spacer 28.

Moreover, as shown in FIG. 1, conical tapered faces 18*a* are formed at both sides of the rubber plugs 18 for inserting the electric wires 20 therethrough. The inner diameter of the rubber plugs 18 (that is, the diameter of the electric wire insertion holes 18*b* of the rubber plugs 18) is set to be equal to or larger than the diameter of the electric wires 20. Further, the outer diameter of the rubber plugs 18 is set to be larger than the diameter of the rubber plug chambers 19 so that the sealing relationship can be provided in the rubber plug chambers 19. Moreover, small diameter parts 18*c* are provided at both end sides of the rubber plugs 18. The small diameter parts 18*c* at both end sides of the rubber plugs 18 can be accommodated in each rubber plug chamber 19 and the recessed rubber plug holders 28*e* of the spacer 28 at the time of the temporary engagement state with the front side of the body 28*a* of the spacer 28 fitted in the inner wall part 17*a* of the outer housing 17. Since the other configuration is same as the related waterproof connector 10', same numerals are applied to the same components, and further explanation is not provided herein.

In assembling the waterproof connector 10 of this embodiment, the packing 24 is inserted and set in the packing receiving part 25 of the inner wall part 17*a* of the outer housing 17 comprising the outside of the connector housing 11 preliminarily.

Then, as shown in FIG. 1, the spacer 28 is fitted in the inner wall part 17*a* of the outer housing 17 for the temporary engagement with each rubber plug 18 interposed between the reverse conical face 19*a* of each rubber plug chamber 19 inside the bottom wall part 17*c* of the outer housing 17 and the recessed rubber plug holder 28*e* outside each electric wire insertion hole 33 of the bottom wall part 28*c* of the spacer 28. That is, the front side of the body 28*a* of the spacer 28 is fitted into the inner wall part 17*a* of the outer housing 17 for the temporary engagement with the small diameter parts 18*c* at both ends of each rubber plug 18 interposed between the reverse conical face 19*a* of each rubber plug chamber 19 and the recessed rubber plug holder 28*e* around each electric wire insertion hole 33 of the bottom wall part 28*c* of the spacer 28, without completely accommodating each rubber plug 18 in each rubber plug chamber 19 inside the bottom wall part 17*c* of the outer housing 17.

The electric wires 20 are inserted through a plurality of the electric wire insertion holes 21 of the bottom wall part 17*c* of the outer housing, the electric wire insertion holes 18*b* of the rubber plugs 18, and the electric wire insertion holes 33 of the bottom wall part 28*c* of the spacer 28 from the outside. Then, as shown in FIG. 2, after press-connecting the electric wires 20 with the pair of the press-connecting blades 14*b* of each female terminal 14 accommodated in each terminal chamber 13 of the divided inner units 12A, 12B, 12C of the inner housing 12 comprising the inside of the connector housing 11, the upper stage, middle stage, and lower stage divided inner units 12A, 12B, 12C are fitted to the inside of the body 28*a* of the spacer 28 successively so as to form the inner housing 12 in the body 28*a* of the spacer 28. At the time, as shown in FIG. 3, the divided inner units 12A, 12B, 12C are attached in the body 28*a* of the spacer 28 by successively fitting therein while sliding the electric wires 20 connected with the divided inner units 12A, 12B, 12C with respect to each electric wire insertion hole 33 of the bottom wall part 28*c* of the spacer 28 and each electric wire insertion hole 21 of the bottom wall part 17*c* of the outer housing 17.

Next, as shown in FIG. 4, if the body 28*a* of the spacer 28 is completely fitted in the inner wall part 17*a* of the outer housing 17 for the full engagement, the rubber plugs 18 are accommodated in the rubber plug chambers 19 with pressure by the rubber plug holders 28*e* of the bottom wall part 28*c* of the spacer 28 as well as the engaging parts 15 of the upper stage and lower stage divided inner units 12A, 12C are engaged with the engagement holes 23 of the outer housing 17 so as to complete the assembly of the waterproof connector 10 with the electric wires 20 sealed with the rubber plugs 18. As As mentioned above, since the divided inner units 12A, 12B, 12C comprising the inner housing 12 are successively fitted into the body 8*a* of the spacer 28 fitted in the inner wall part 17*a* of the outer housing 17 via the rubber plugs 18 in the temporary engagement state, even in the case a large number of the rubber plugs 18 are used, the sliding friction force between the rubber plugs 18 and the electric wires 20 can be dispersed so that the electric wires 20 can be assembled smoothly without bend, and thus the operation load (fitting load) can be alleviated. Accordingly, a multi-way waterproof connector 10 having the excellent waterproof property can be assembled easily in a short time. That is, production of the wire harness comprising a flux of a plurality of the electric wires 20 can be facilitated so that the assembly operativity as a whole can further be improved. Furthermore, since the rubber plugs 18 can be accommodated smoothly and certainly in each rubber plug chamber 19 of the outer housing 17 owing to the rubber plug holders 28*e* of the spacer 28, the sealing property of the waterproof connector 10 can be improved.

Moreover, since-the rubber plugs 18 can be accommodated easily and certainly in each rubber plug chamber 19 of the outer housing 17 at the time of the full engagement by completely fitting the spacer 28 fitted in the inner wall part 17*a* of the outer housing 17 via the rubber plugs 18 in the temporarily engaged state into the inner wall part 17*a* of the outer housing 17 after attaching the divided inner units 12A, 12B, 12C as well as the full engagement state can be maintained further easily and certainly owing to the engagement of each projection 15 of each divided inner unit 12A, 12B, 12C of the spacer side 28 and each engagement hole 23 of the outer housing 17. Accordingly, the assembly quality of the waterproof connector 10 can be improved.

Although the case of press-connecting of the electric wires to the pressure terminals has been explained in the above-mentioned embodiments, the terminals are not limited to the pressure terminals, but the embodiments can also be adopted to the case of the pressure connection of the electric wires to crimp-style terminals.

What is claimed is:

1. A waterproof connector comprising:

a plurality of inner units, each inner unit having a terminal chamber for accommodating a terminal to which an electric wire is connected, which are to be detachably combined with each other to constitute an inner housing;

a plurality of waterproof rubber plugs, each plug having a through hole through which the electric wire is inserted;

a spacer having side walls for defining a chamber provided with a bottom wall, into which the inner units are fitted;

a plurality of through holes, through which the respective electric wires are inserted, formed on the bottom wall of the spacer so as to face the associated terminal chambers of the respective inner units when the inner housing is fitted into the chamber of the spacer;

an outer housing having sidewalls for defining a chamber provided with a bottom wall, into which the spacer is fitted;

a plurality of through holes, through which the respective electric wires are inserted, formed on the bottom wall of the outer housing so as to face the associated through holes of the spacer when the spacer is fitted into the chamber of the outer housing;

a plurality of recesses formed on the bottom wall of the outer housing so as to communicate with the respective through holes of the outer housing in order to accommodate the rubber plugs when the spacer is completely fitted into the chamber of the outer housing, thereby sealing the electric wires and the terminal chambers, entrance peripheries of the respective recesses being tapered;

a plurality of rubber plug holders formed on the bottom wall of the spacer so as to communicate with the through holes of the spacer in order to hold the rubber plugs together with the respective tapered peripheries of the recesses therebetween before the rubber plugs are accommodated in the respective recesses.

2. The waterproof connector as set forth in claim 1, wherein the inner housing is composed of at least three inner units;

wherein the outermost inner units respectively have an engagement member engaged with the outer housing; and wherein at least one inner units arranged between the outermost inner units has an engagement member engaged with both adjacent inner units.

3. A method for assembling the waterproof connector as set forth in claim 1, comprising the steps of:

fitting the rubber plugs into the entrance peripheries of the associated recesses of the outer housing provisionally;

fitting the spacer into the chamber of the outer housing provisionally such that the rubber plugs are held between the rubber plug holders of the spacer and the entrance peripheries of the recesses;

passing the electric wires through the associated through holes on the bottom wall of the outer housing;

passing each electric wire through the through hole of the associated rubber plug;

passing the electric wires through the associated through holes of the spacer;

connecting the electric wires to the associated terminals;

fitting each terminal into the terminal chamber of the associated inner unit;

fitting the respective inner units into the chamber of the spacer successively to constitute the inner housing therein;

fitting the spacer into the chamber of the outer housing completely while press-fitting the rubber plugs into the associated recesses.

* * * * *